US007206008B2

(12) United States Patent
Dejong et al.

(10) Patent No.: US 7,206,008 B2
(45) Date of Patent: Apr. 17, 2007

(54) METHOD FOR CALIBRATING COLOR IN A PRINTING DEVICE

(75) Inventors: Joannes N M Dejong, Hopewell Junction, NY (US); Lloyd A. Williams, Mahopac, NY (US); Vittorio Castelli, Yorktown Heights, NY (US)

(73) Assignee: Xerox Corporation, Stamford, CT (US)

( * ) Notice: Subject to any disclaimer, the term of this patent is extended or adjusted under 35 U.S.C. 154(b) by 262 days.

(21) Appl. No.: 10/975,654

(22) Filed: Oct. 28, 2004

(65) Prior Publication Data

US 2006/0092257 A1 May 4, 2006

(51) Int. Cl.
*G03G 13/01* (2006.01)

(52) U.S. Cl. ..... 347/116; 399/301

(58) Field of Classification Search ..... 347/116; 300/301

See application file for complete search history.

(56) References Cited

U.S. PATENT DOCUMENTS 4,611,901 A 9/1986 Kohyama et al.
4,660,059 A 4/1987 O'Brien
4,833,503 A 5/1989 Snelling
5,442,388 A * 8/1995 Schieck ..... 347/116
5,642,202 A 6/1997 Williams et al.
5,821,971 A 10/1998 Rauch et al.
5,889,545 A 3/1999 Rauch et al.
6,137,517 A 10/2000 Furst et al.
6,141,464 A 10/2000 Handley
6,178,031 B1 1/2001 Rauch et al.
6,275,244 B1 8/2001 Omelchenko et al.
6,300,968 B1 10/2001 Kerxhalli et al.
6,418,295 B1 * 7/2002 Sato ..... 399/301
2003/0210412 A1 * 11/2003 Ishibashi ..... 358/1.9

* cited by examiner

*Primary Examiner*—Huan Tran
(74) *Attorney, Agent, or Firm*—Joseph M. Young

(57) ABSTRACT

A method for improving color-to-color registration in a printing device. The method includes printing a plurality of multi-color images, measuring the relative locations of a first portion of each multi-color image having a first color of each image and a second portion of each multi-color image having a second color of each image, for each image, comparing at least one difference between the first portion's location and the second portion's location with at least one desired difference between the first portion's location and the second portion's location to generate a list of positional errors, using a least square regression analysis of the list of positional errors to determine shift amounts required for placement of each first portion in subsequently generated images to within a desired degree of accuracy, and adjusting the placement of the first portion of each subsequently generated image by the determined shift amounts.

13 Claims, 6 Drawing Sheets

METHOD FOR CALIBRATING COLOR IN A PRINTING DEVICE

The embodiments disclosed herein are directed to color calibration methods for printing devices.

In various reproduction systems, including xerographic printing, the control and registration of the position of imageable surfaces such as photoreceptor belts, intermediate transfer belts (if used), or images thereon, is critical, and a well developed art, as shown by the exemplary patents cited below. It is well known to provide various single or dual axes control systems, for adjusting or correcting the lateral position or process position or timing of a photoreceptor belt or other image bearing member of a reproduction apparatus, such as by belt lateral steering systems or belt drive motor controls, or adjusting or correcting the lateral position or process position or timing of the placing of images on the belt with adjustable image generators such as laser beam scanners or ink-jet devices.

An important application of such accurate image position or registration systems is to accurately control the positions of different colors being printed on the same intermediate or final image substrate, to insure the positional accuracy (adjacency or overlapping) of the various colors being printed. That is not limited to xerographic printing systems. For example, precise registration control may be required over different ink jet printing heads or vacuum belt or other sheet transports in a plural color ink jet printer.

It is well known to provide image registration systems for the correct and accurate alignment, relative to one another, on both axes (the lateral axis or the process direction axis), of every portion of different plural color images on an initial imaging bearing surface member such as (but not limited to) a photoreceptor belt of a xerographic color printer. That is, to improve the registration accuracy of such plural color images relative to one another or to the image bearing member, so that all portions of the different color images may be correctly and precisely positioned relative to one another or superposed and combined for a composite or full color image, to provide for customer-acceptable color printing on a final image substrate such as a sheet of paper. The individual primary color images to be combined for a mixed or full color image are often referred to as the color separations.

Known means to adjust the registration of the images on either or both axes relative to the image bearing surface and one another include adjusting the orientation and the position or timing of the images being formed on the image-bearing surface. That may be done by control of ROS (raster output scanner) laser beams or other known latent or visible image forming systems.

In particular, it is known to provide such imaging registration systems by correcting the registration of all portions of the images as a response to registration errors measured by means of marks-on-belt (MOB) systems, in which selected areas of the image are marked with registration positional marks, detectable by an optical sensor. The marked areas could be in the space normally covered by the images, or outside of it. These MOB sensors sense the relative position of the registration marks in both the lateral and process directions. In spite of their name, MOB systems can be used with any image-carrying medium such as, for example, belts, rigid cylinders, or flat plates. For the purpose of belt motion control and motion registration systems (previously described) such registration marks can be permanent, such as by silk screen printing or otherwise permanent marks on the belt, such as belt apertures, which may be readily optically detectable. However, for image position control relative to other images on the belt, or the belt position, especially for color printing, typically these registration marks are not permanent. Typically, they are distinctive marks imaged on, or adjacent to, the respective image, and developed with the same toner or other developer material as is being used to develop the associated image. Such MOB image position or registration indicia are thus typically repeatedly developed and erased in each rotation of the photoreceptor belt. It is normally undesirable, of course, for such registration marks to appear on the final prints (on the final image substrate), unless they can be eliminated by off-line trimming.

Color registration systems for printing, as here, should not be confused with various color correction or calibration systems, involving various color space systems, conversions, or values, such as color intensity, density, hue, saturation, luminance, chrominance, or the like, as to which respective colors may be controlled or adjusted. Color registration systems, such as that disclosed herein, relate to positional information and positional correction (shifting respective portions of color images laterally or in the process direction or providing image rotation or image magnification) so that different colors may be accurately superposed or interposed for customer-acceptable full color or intermixed color or accurately adjacent color printed images. The human eye is particularly sensitive to small printed color misregistrations of one color relative to one another in superposed or closely adjacent images, which can cause highly visible color printing defects such as hue shifts, color bleeds, non-trappings (white spaces between colors), halos, ghost images, etc.

Various systems and methods have been developed to control registration of image on paper after an initial registration has been made. Examples of such registration systems include those shown and described in U.S. Pat. Nos. 5,821,971; 5,889,545; 6,137,517; 6,141,464; 6,178,031; 6,275,244; and 6,300,968; the subject matter of each of the preceding patents is hereby incorporated herein in its entirety.

U.S. Pat. No. 5,642,202, the subject matter of which is incorporated herein by reference in its entirety, discloses a process for initial registration calibration of a printing system including a printer and a master test image document printed by the printer.

The modern approach to color registration is to 1) correct repeatable errors in the components and their assemblies by means of factory and self-calibration procedures; 2) correct errors that change in time (drift) by means of periodic self-correction procedures; 3) correct unpredictable errors by servo and servo-like procedures. All these procedures assume the ability to quantitatively sense the errors, and the availability of proper actuators. The error data is then used to properly locate each color separation and maintain IOI registration.

The determination of the proper correction functions is essential to the application of this approach. The discontinuous error data are usually approximately fitted with continuous functions so that proper interpolation can be performed when the actuators implement the corrections. Typical correction functions are Fourier series, because most of the errors are periodic. However the determination of the coefficients is rendered difficult by the fact that error data are available over stretches of time or space separated by interruptions. This is due to the fact that images (which in this case are special marks to be read by the sensors) can only be written in some of the area of the image-bearing device, such as a belt, a cylinder, etc. To compensate for the inherent lack of accuracy obtained by standard methods for the determination of Fourier coefficients, such as straight integration and in order to provide more accurate calibration, it is proposed to fit the data with one simultaneous fit of all functions over all available data by means of a least square procedure. It can be shown that this approach produces much better fits to the coefficients than conventional integral techniques, however compensated. In embodiments, this fit is performed for each color separation individually. Also, the process direction and lateral direction errors can usually be treated separately.

Embodiments include a method for improving color-to-color registration in a printing device. The method includes printing a plurality of multi-color images, measuring the relative locations of a first portion of each multi-color image having a first color of each image and a second portion of each multi-color image having a second color of each image, for each image, comparing at least one difference between the first portion's location and the second portion's location with at least one desired difference between the first portion's location and the second portion's location to generate a list of positional errors, using a least square regression analysis of the list of positional errors to determine shift amounts required for placement of each first portion in subsequently generated images to within a desired degree of accuracy, and adjusting the placement of the first portion of each subsequently generated image by the determined shift amounts.

Various exemplary embodiments will be described in detail, with reference to the following figures, wherein.

Figure 1:
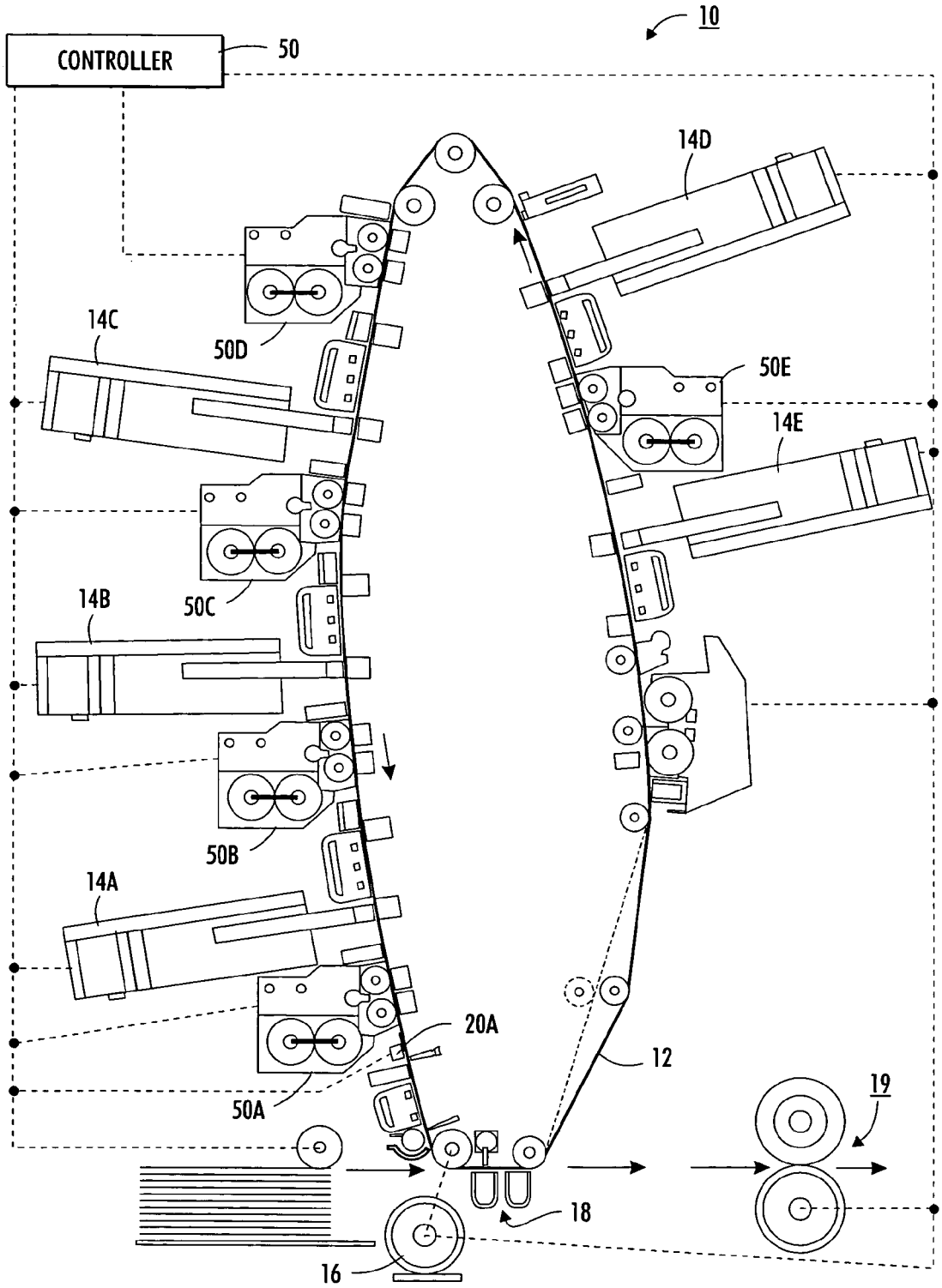
FIG. 1 is a schematic frontal view of one example of a reproduction system for incorporating one example of the subject registration system, in this case, a color-on-color xerographic printer.

FIG. 1 schematically illustrates a printer 10 as one example of an otherwise known type of xerographic, plural color "image-on-image" (IOI) type full color (cyan, magenta, yellow and black imagers) reproduction machine, merely by way of one example of the applicability of the current cursor correction system. A partial, very simplified, schematic perspective view thereof is provided in FIG. 2. This particular type of printing is also referred as "single pass" multiple exposure color printing. It has plural sequential ROS beam sweep PR image formations and sequential superposed developments of those latent images with primary color toners, interspersed with PR belt re-charging. Further examples and details of such IOI systems are described in U.S. Pat. Nos. 4,660,059; 4,833,503; 4,611,901; etc.

However, it will be appreciated that the disclosed improved registration system could also be employed in non-xerographic color printers, such as ink jet printers, or in "tandem" xerographic or other color printing systems, typically having plural print engines transferring respective colors sequentially to an intermediate image transfer belt and then to the final substrate. Thus, for a tandem color printer it will be appreciated the image bearing member on which the subject registration marks are formed may be either or both on the photoreceptors and the intermediate transfer belt, and have MOB sensors and image position correction systems appropriately associated therewith. Various such known types of color printers are further described in the above-cited patents and need not be further discussed herein.

Figure 2:
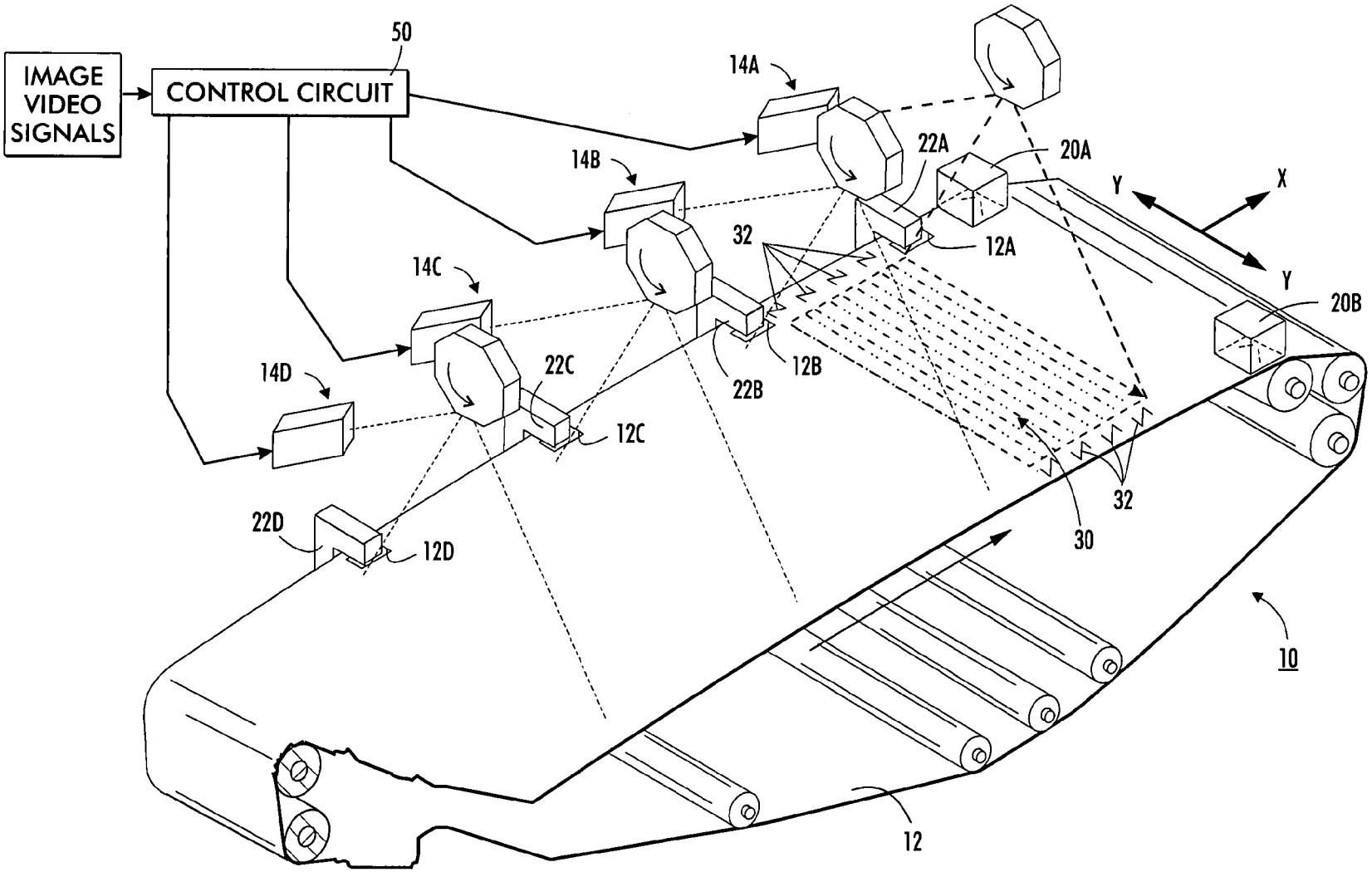
FIG. 2 is a simplified schematic perspective view of part of the embodiment of FIG. 1 for better illustrating exemplary sequential ROS generation of plural color latent images and associated exemplary latent image registration marks for MOB sensing (with development stations, etc., removed for illustrative clarity).

Referring to the exemplary printer 10 of FIGS. 1 and 2, all of its operations and functions may be controlled by programmed microprocessors, as described above, at centralized, distributed, or remote system-server locations, any of which are schematically illustrated here by the controller 50. A single photoreceptor belt 12 may be successively charged, ROS (raster output scanner) imaged, and developed with black or any or all primary colors toners by a plurality of imaging stations. In this example, these plural imaging stations include respective ROS's 14A, 14B, 14C, 14D, and 14E; and associated developer units 50A, 50B, 50C, 50D, and 50E. A composite plural color imaged area 30, as shown in FIG. 2, may thus be formed in each desired image area in a single revolution of the belt 12 with this exemplary printer 10, providing accurate registration can be obtained. Two MOB sensors (20A in FIG. 1, 20A and 20B in FIG. 2) are schematically illustrated, and will be further described herein concerning such registration.

It is important to note that while MOB sensors are shown in use with a photoreceptor belt, they are not limited such use. The sensors may also be used in conjunction with an intermediate transfer belt (ITB). Further, each MOB sensor detects the relative positions of all colors with respect to a particular color used as reference. The pair of MOB sensors 20A and 20B in FIG. 2 detect errors in the relative positions of all the color separations of a standard four-color image at both lateral ends of the images themselves. Thus errors can be measured in four varieties: improper position in the process direction, improper position in the lateral direction, improper line rotation, and improper image width. These errors are measured as distributed in the process direction. Fourier analysis has been used to fit these four error distributions in the process and lateral directions.

In embodiments, developer units 50A–D are used to develop black, cyan, yellow, and magenta, respectively. These separate color images (usually called color separations) are developed successively with appropriate time delays so that they become overlapped on the photoreceptor belt before being transferred to a sheet of paper.

The belt 12 has a conventional drive system 16 for moving it in the process direction shown by its movement arrows. A conventional transfer station 18 is illustrated for the transfer of the composite color images to the final substrate, usually a paper sheet, which then is fed to a fuser 19 and outputted.

Referring to FIG. 2, it may be seen that registration holes 12A, 12B, 12C, 12D, etc., (or other permanent belt marks, of various desired configurations) may also be provided along one or both edges of the photoreceptor belt 12. These holes or marks may be optically detected, such as by belt hole sensors, schematically shown in this example in FIG. 2 as 22A, 22B, 22C, 22D. Various possible functions thereof are described, for example, in the above-cited patents. If desired, the holes or other permanent belt markings may be located, as shown, adjacent respective image areas, but it is not necessary that there be such a mark for each image position, or that there be plural sensors. Also, the number, size and spacing of the image areas along the photoreceptor belt may vary in response to various factors including, for example, when larger or smaller images are being printed.

In FIG. 2 it may be seen that toner registration mark images 32 have been formed along both sides of the printer 10 photoreceptor belt 12, adjacent but outside of its imaged area 30, as will be further described. However, those "Z" marks 32 can be replaced with chevron-shaped toner registration mark images, such as those shown in FIG. 3, or expanded chevrons as shown and described in U.S. Pat. No. 6,300,968, issued Oct. 9, 2001 (the '968 patent). Examples of other types of MOB are given in the '968 patent as well. The particular shape of the marks is not important to the present invention. These marks are used to measure how well the images drawn on the belt at different stations are aligned with each other, so that corrections may be made where needed. When printing multi-color documents it is important to keep the colors aligned.

MOB registration marks corresponding to different toner colors are imaged and developed in close alignment both with respect to each other and with respect to the MOB sensors 20A, 20B. U.S. Pat. No. 6,275,244 discloses an exemplary image-on-image (IOI), or color on color, registration setup system, the subject matter of which has already been incorporated in its entirety. The IOI registration setup aligns the MOB registration marks 32 along the sides of the belt with the MOB sensors 20A, 20B. After IOI registration setup has been performed, all the colors—magenta, yellow, cyan, and black—are aligned to each other, and the MOB registration marks are within the lateral sensing range of the MOB sensors. An exemplary registration system includes the following elements: an initial image registration or setup mode, an expanded chevron registration mode, and a standard regular or fine registration mode.

An initial image registration or setup mode, which can provide initial registration even from a gross initial misregistration. Initial gross color images misregistration can exist, for example, when the machine is first run after manufacturing, or after a service call, after a ROS repair, after a PR belt change, etc. In such cases the initial lateral position of each color image area, and thus its directly associated MOB position on the PR belt 12, could be out of registration by +/−3 mm, for example. If the MOB sensor 20A or 20B has a lateral sensing range for a standard chevron belt mark target 34 of less than 1 mm, it will not properly capture the marks within its lateral optical range. In order to insure that the MOB sensors "see" each color registration mark 34 in this initial state (the image registration setup mode), there is provided an initial generation, during this initial state only, of "Z" shaped color registration marks (for example, registration marks 32 in FIG. 2), providing the MOB sensors with a greater (but less accurate) lateral sensing range, instead of chevron shaped marks such as 34A–F. Appropriate initial use of such "Z" marks instead of chevron marks on the belt for initial registration can increase the lateral sensing range of the MOB sensors in that mode of operation by an order of magnitude, e.g., from approximately +/−1 mm for chevron marks to approximately +/−10 mm for "Z" marks. The approximate location of the marks is then changed by the machine control system so that chevron marks can be completely and accurately detected by the MOB sensor.

This optional "expanded chevron" step or mode provides a target pattern that will allow a coarse color registration adjustment. That is, this mode provides a different target that will allow the marks-on-belt sensor to detect the position of each color even if there is a large amount of process direction error between the colors. The MOB sensors may not readily detect color positions with the standard size chevrons ensemble if there is a large amount of lateral or process registration error between the colors, because the marks may be nominally too close together. In the expanded chevron ensemble, however, the marks are spaced out sufficiently in the process direction so that there is no overlap of colors in the presence of large process direction errors. For example, by providing an expanded chevron dimension in the process direction of about 7.4 mm as opposed to a normal chevron dimension in the process direction of about 0.72 mm. However, the angles of the legs of these expanded chevrons may remain the same. The transverse dimension (widths) of these chevrons may also be the same, e.g., about 10.4 mm.

This initial or gross registration mode or step is then followed by switching to a standard regular or fine registration mode or step of developing standard chevron shaped registration marks on the photoreceptor belt, as taught in the above-cited and other patents. Both of these different sets of different marks may provide the MOB registration marks for the registrations of the different colors of a plural color printer.

These steps are repeated until the positions of the different color registration marks are substantially aligned with each other and with the MOB sensors.

Figure 3:
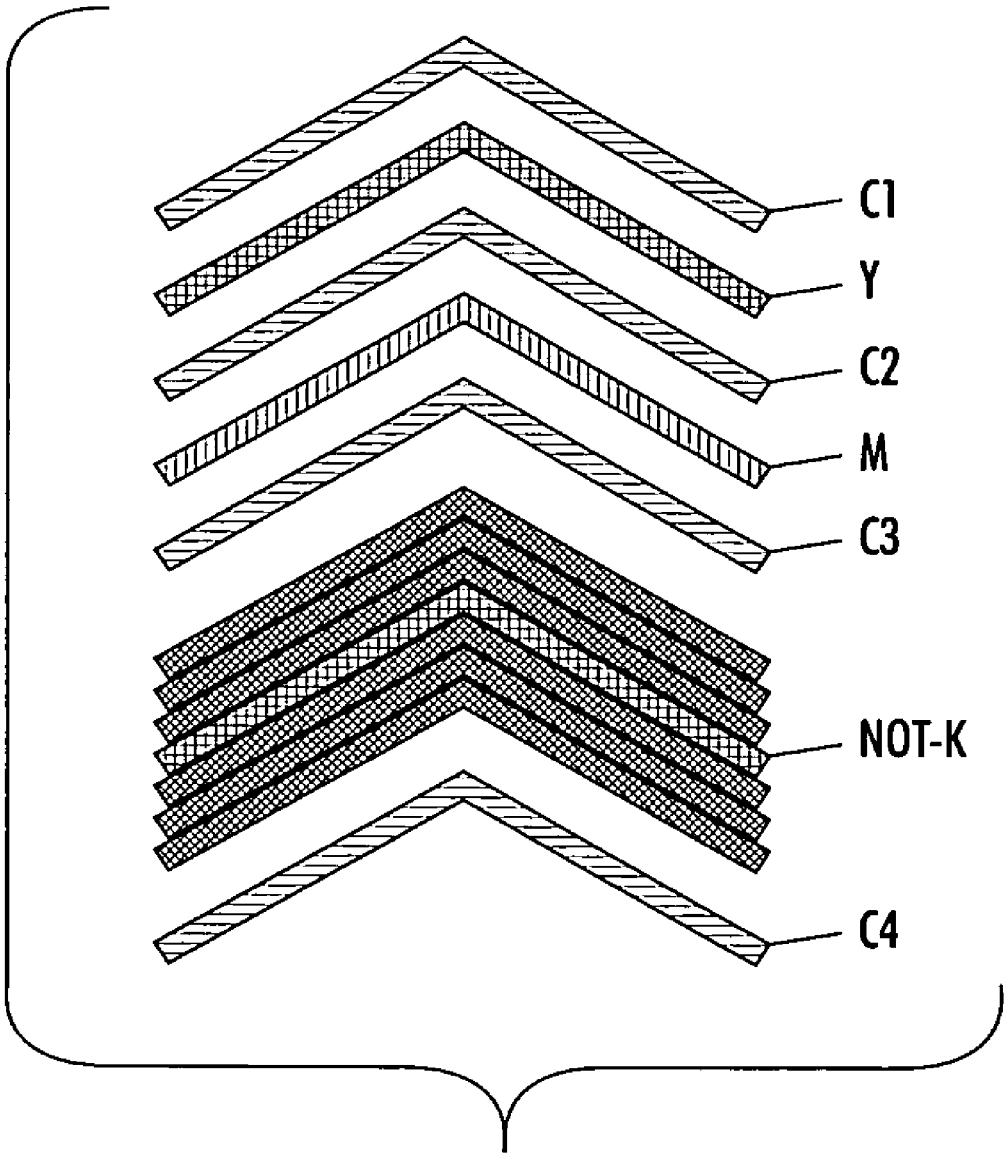
FIG. 3 is an exemplary chevron pattern.

Typically, MOB sensors carry their own infrared illumination. The reading of the marks depends on optical contrast. Due to the poor contrast of the black toner on the belt, the black position is often measured indirectly. For example, using a traditional YMCK printing sequence, the black chevron can be printed as Not-K, which is a field of black with a missing chevron on a field of yellow. FIG. 3 shows an exemplary chevron pattern with cyan, magenta, yellow, and Notblack chevrons. In embodiments, the first 5 chevrons, C1, Y, C2, M, and C3, are spaced about 0.1" form each other in the process direction and the spacings between C3 and Not-K, and between Not-K and C4 are about 0.2" each. Usually, the pitch of the chevron sets is about 1".

Figure 4:
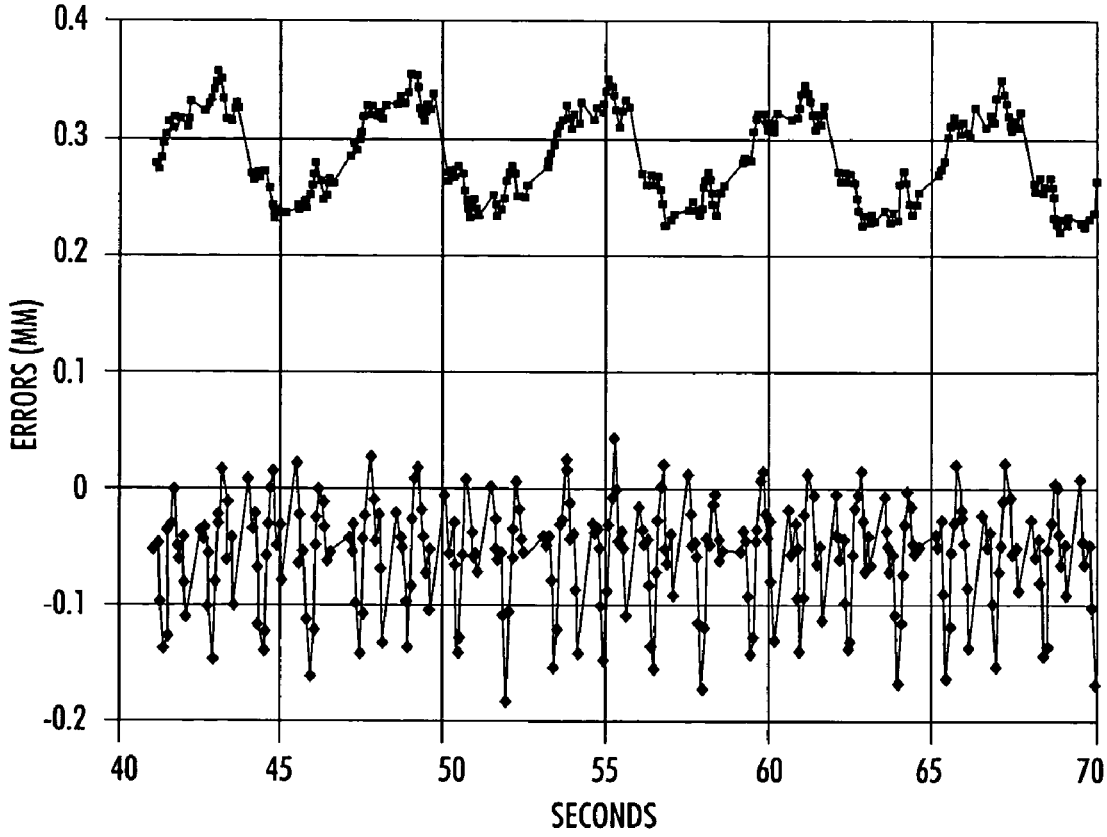
FIG. 4 is an exemplary chart of the error in the relative position of a yellow portion to a cyan portion of a test image over a sequence of time intervals.

Black is often used as a reference color. The positions of the yellow, cyan, and magenta chevrons are usually measured relative to the position of the black (Not-K) chevron. However, other separations may be used as the reference color. In some printers, cyan is used as the reference color. FIG. 4, for example, shows an exemplary plot of error information for yellow relative to cyan. (However, the error data could have been based upon the relative positions of any two-color separations being printed.) In this graph, the abscissa units are microseconds and the ordinate unites are millimeters FIG. 4 shows error distributions in time of the yellow relative to cyan, as measured by an on-board MOB sensor. The upper trace shows the lateral registration error at one sensor, and the lower trace represents the error in the process direction.

The problem at hand is to translate the raw data obtained by an MOB sensor into correctible errors, which can then be compensated for by adjusting the location of the separation corresponding to that sensor. There are multiple factors that contribute to these errors and these factors include both constant and periodic errors. Errors in the color-to-color registration can be caused by geometrical or control errors in components such as intermediate or photoreceptor belts, photoreceptor drums, drive components, etc. More information is necessary to keep the phases correctly. This is provided by indexes in encoders, marks or holes in belts, etc. For example, in a tandem IOT, harmonics of the belt rotation and harmonics of the rotation of each of two photoreceptor drums can all contribute. Other frequencies may also be relevant, such as that of some drive components. Periodic errors can be introduced by a rotating photoreceptor belt or, in printing devices that include an intermediate transfer belt, the ITB as well. These can be due to a variety of factors including skew (the rotation of an image or image portion about an axis perpendicular to the image) and magnification (the improper length or width of the separations), etc.

The traditional method to determine the proper error equation is to use the definition of Fourier coefficients, which is a properly weighed integration of the error data multiplied by appropriate sine or cosine functions over the collection interval. For each separation, one extracts the first Fourier series, subtracts from the data captured by the MOB sensors; then one fits the second Fourier series, subtracts from the data, and so on. When Fourier analysis is used, there can be difficulty fitting a finite number of Fourier components to this type of data. Two problems arise: the first is in the treatment of the time intervals where data are not available; the second is in the fact that data may not cover complete cycles. One plausible method is to integrate over the available data only. It is obvious that this does not exactly reproduce the intent of the Fourier integrals. A second method starts as the previous method, but then it creates data in the missing regions, and repeats the process iteratively. When this was attempted, there were no problems with convergence. However, it can be shown that also this method has fundamental errors because it is based upon the extraction of Fourier coefficients for continuous data.

An improvement over both these methods can be realized by using regression analysis techniques. Fitting the data to the linear and sinusoidal errors by a least square method produces much more accurate results because the weighting is performed only where the data exist. It consists of simultaneously fitting the DC correction and the time variable parts of all other truncated Fourier series by means of a simultaneous least square fit or singular value decomposition. This fit is performed in both the lateral and process directions.

In embodiments, the following exemplary method was used to fit the error data to lateral and process curves. The error corrections for each color separation are performed separately. Equations 1–5 apply to a single separation (Y, C, or M) relative to black. For convenience, we will discuss the difference in terms of yellow. The following correction calculations were performed for yellow relative to black. The error between the target location of a chevron $$E_{pi}=D_{pi}-D_{pi}^{o} \tag{1a}$$

$$E_{li}=D_{li}-D_{li}^{o} \tag{1b}$$

where $E_{pi}$ is the error in the process direction at ith data point, $E_{li}$ is the error in the lateral direction at the ith data point, $D_{pi}$ is the actual location in the process direction of sensor reading at the ith data point, $D_{pi}^{o}$ is the target location in the process location at ith data point, $D_{li}^{o}$ is the actual location in the lateral direction of sensor reading at ith data point, and $D_{li}^{o}$ is the target location in the lateral location at Ah data point.

As discussed, the error has both periodic and constant portions. Therefore, the error is expected to be the following:

$$D_{pi}-D_{pi}^{o}=C_p+V_{pi}+\sum_{j=1}^{i}[A_{pj}\sin(j\omega_B t)+B_{pj}\cos(j\omega_B t)]+\sum_{k=1}^{i}[C_{pk}\sin(k\omega_{PR}t)+D_{pk}\cos(k\omega_{PR}t)] \tag{2a}$$

$$D_{li}-D_{li}^{o}=C_l+V_{li}+\sum_{j=1}^{i}[A_{lj}\sin(j\omega_B t)+B_{lj}\cos(j\omega_B t)]+\sum_{k=1}^{i}[C_{lk}\sin(k\omega_{PR}t)+D_{lk}\cos(k\omega_{PR}t)] \tag{2b}$$

where, $C_p$ is the constant process direction error, $C_l$ is the constant lateral direction error, t is a standard time interval between generated images; $\omega_{PR}$ is the frequency of photoreceptor revolution, $\omega_B$ is the frequency of ITB revolution, $A_{pj}$, $B_{pj}$, $C_{pk}$, and $D_{pk}$ are the coefficients of the periodic terms of the process error due to a photoreceptor and an ITB, and $A_{lj}$, $B_{lj}$, $C_{lk}$, and $D_{lk}$ are the coefficients of the periodic terms of the lateral error due to a photoreceptor and an ITB. $V_{pi}$ and $V_{li}$ represent iterative errors in the process and lateral directions due to such things as scanners gradually moving out of alignment or belt shifts in a lateral direction. This example assumes that both a photoreceptor and an ITB are being used. In this case, the MOB sensor data being used would be taken from the ITB. In embodiments where an ITB was not being used, the MOB sensor data would be taken from the photoreceptor directly. This would eliminate the ITB terms and simplify $E_{pi}$ and $E_{li}$.

$$QP=\sum_{i}^{N}E_{pi}^2 \tag{3a}$$

$$QL=\sum_{i}^{N}E_{li}^2 \tag{3b}$$

where QP is the value to be minimized for process direction adjustments, QL is the value to be minimized for lateral direction adjustments, and N is the number of data points used from the MOB sensors. From Equations 1–3, Equations 4 and 5 can be derived:

$$QP=\sum_{i}^{N}[(D_{pi}-D_{pi}^{o})^2 \tag{4a}$$

$$QL=\sum_{i}^{N}[(D_{li}-D_{li}^{o})^2 \tag{4b}$$

$$QP=\sum_{i}^{N}\left\{\begin{array}{l}C_p+V_{pi}+\sum_{j}^{i}[A_{pj}\sin(j\omega_B t)+B_{pj}\cos(j\omega_B t)]+\\ \sum_{k}^{i}[C_{pk}\sin(k\omega_{PR}t)+D_{pk}\cos(k\omega_{PR}t)]\end{array}\right\}^2 \tag{5a}$$

-continued $$QL = \sum_{i}^{N} \left\{ \begin{array}{l} C_i + V_{li} + \sum_{j}^{i} [A_{lj}\sin(j\omega_B t) + B_{lj}\cos(j\omega_B t)] + \\ \sum_{k}^{i} [C_{lk}\sin(k\omega_{PR} t) + D_{lk}\cos(k\omega_{PR} t)] \end{array} \right\}^2 \quad (5b)$$

Multiple simultaneous least squares solution methods can be applied to fit this data to error data that is collected and this can provide more accurate results than fitting the data to a Fourier transform. A variety of well-known techniques may be used to minimize the values QP and QL. These include, for example, Monte Carlo, Levenberg-Marquart, and Gauss-Newton techniques.

N can get quite large, and as i approaches N, i gets quite large. The periodic terms do not typically need to be calculated beyond the fourth loop of the belt. The third or fourth harmonic of the periodic terms is usually attenuated enough that further calculation is unnecessary. Therefore, for practical computational purposes values of j and k beyond 4 do not need to be calculated.

Once the proper expression for the error has been determined, the error data needs to be translated into corrections to the locations of the separations in an image so that they are properly calibrated with respect to a reference separation. For example, once the coefficients of the curves of Equations 5 have been found to a particular degree of accuracy, this data can be used to control the output of the ROS scanners so that the images are drawn in the appropriate places. This typically will involve modifying the digital data itself so that the device tries to draw the image in a new location. Alternatively, it may involve physical adjustments such as, for example, reorientation of the ROS scanner.

Figure 5:
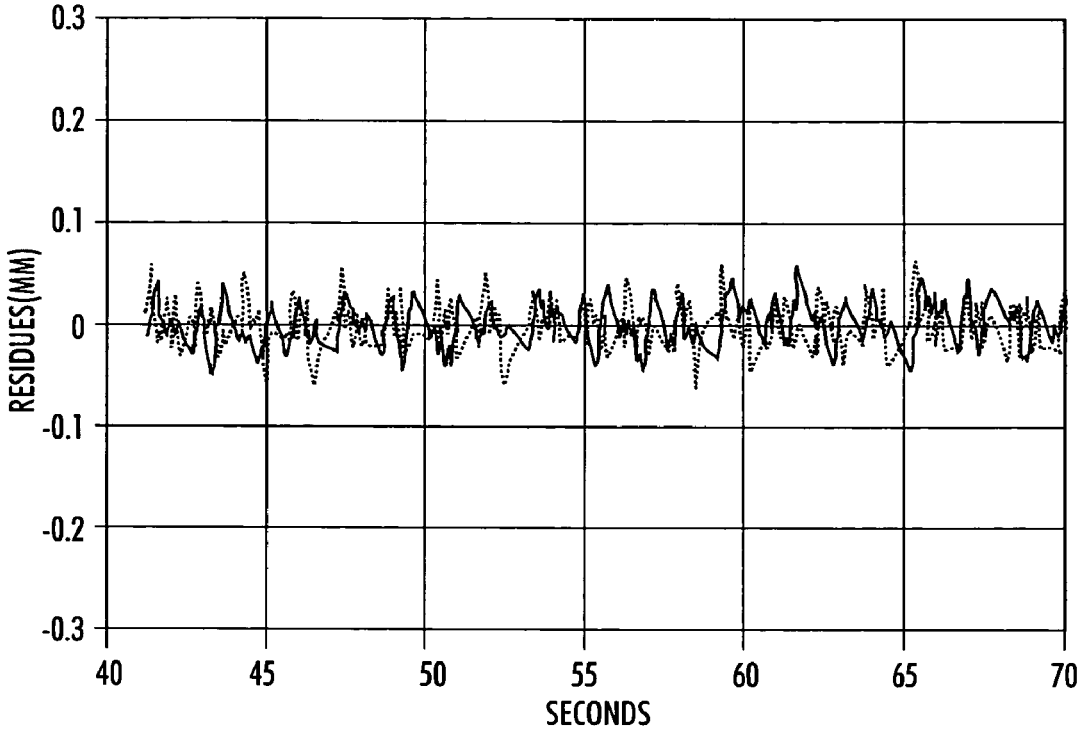
FIG. 5 is an exemplary chart of the error in the relative position of a yellow portion to a cyan portion of a test image over a sequence of time intervals after corrections were determined from Fourier analysis of the data in the chart of FIG. 4.
Figure 6:
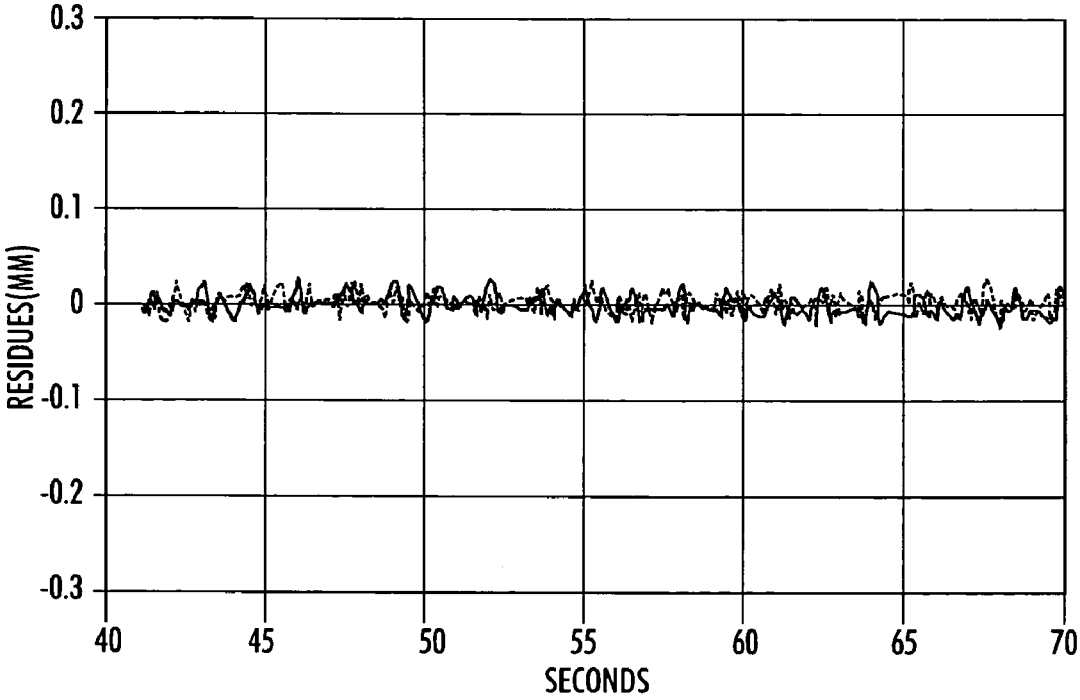
FIG. 6 is an exemplary chart of the error in the relative position of a yellow portion to a cyan portion of a test image over a sequence of time intervals after corrections were determined from least square regression analysis of the data in the chart of FIG. 4.

After applying the iterative integral procedure and the simultaneous least square procedure to the error data of FIG. 4 above, the results shown in FIGS. 5 and 6 were obtained. The first presents the error residue obtained after applying a calibration obtained by the integral method, and the second presents the error residue after application of a calibration obtained by the simultaneous least square fit. The latter represents an improvement of about 50%.

Figure 7:
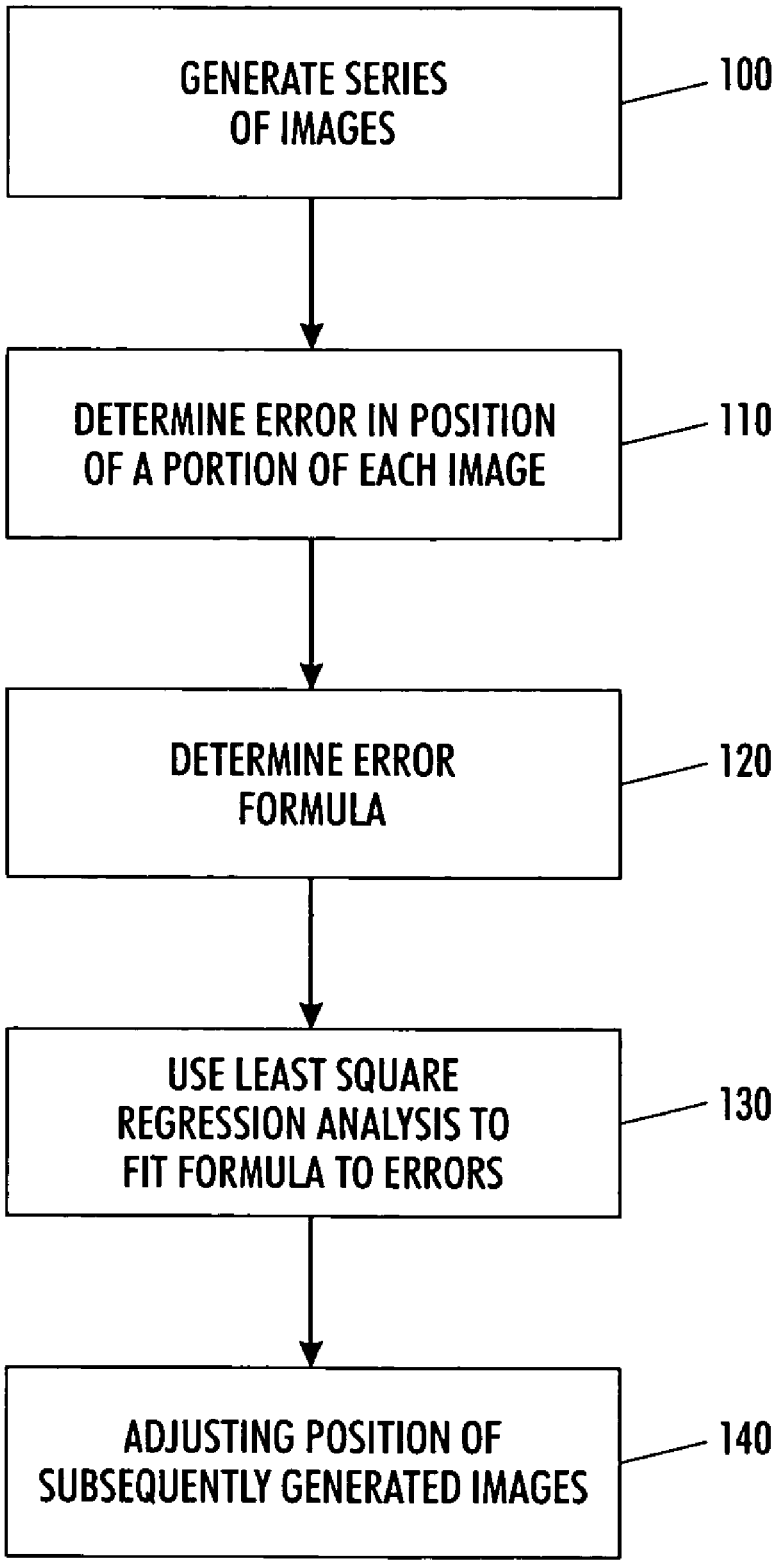
FIG. 7 is a flowchart illustrating an exemplary process for improving color-to-color registration.

FIG. 7 is a flow chart illustrating the present method. First a series of images is generated 100. For example, a series of chevron patterns such as that shown in FIG. 3 is drawn on a photoreceptor or intermediate transfer belt periodically. Next errors in the position of a portion of each image are determined 110. For example, the position of the yellow separation relative to cyan is measured for each chevron. An empirical formula to account for the errors also needs to be created 120. This can be done before or after the previous steps. Contributing terms to the error formula can be hypothesized based upon the nature of the printing process. For example, rotating elements such as belts or drums are likely to introduce periodic errors. Also, an initial misalignment in the position of the ROS scanner, for example, may introduce a constant error. Gradual shifts in the belt position or ROS scanner position may, for example, produce iterative errors. Next, the variables in the hypothetical empirical formula may be calculated to within a desired degree of accuracy by using a least squares regression analysis method 130. Once the variables have been found the formula can then be used to determine how much to adjust the placement of each portion of the image so that it is located closer to its correct position 140.

For the chevron shown in FIG. 3, the relative positions of magenta and black (Not-K) are also measured relative to cyan and each of these separations is also corrected relative to cyan. These corrections are independent of each other and that of the yellow separation.

While the present invention has been described with reference to specific embodiments thereof, it will be understood that it is not intended to limit the invention to these embodiments. It is intended to encompass alternatives, modifications, and equivalents, including substantial equivalents, similar equivalents, and the like, as may be included within the spirit and scope of the invention. All patent applications, patents and other publications cited herein are incorporated by reference in their entirety.

The invention claimed is:

1. A method for improving color-to-color registration in a printing device, comprising:

printing a plurality of multi-color images;

measuring the relative locations of a first portion of each multi-color image having a first color of each image and a second portion of each multi-color image having a second color of each image;

for each image, comparing at least one difference between the first portion's location and the second portion's location with at least one desired difference between the first portion's location and the second portion's location to generate a list of positional errors;

using a least square regression analysis of the list of positional errors to determine shift amounts required for placement of each first portion in subsequently generated images to within a desired degree of accuracy;

adjusting the placement of the first portion of each subsequently generated image by the determined shift amounts.

2. The method of claim 1, wherein the second color is cyan.

3. The method of claim 1, wherein the plurality of images are substantially identical.

4. The method of claim 3, wherein the plurality of images are separated in time a by a substantially constant interval.

5. The method of claim 1, further comprising deriving an empirical error formula based upon expected sources of error, the formula having variable coefficients, wherein the least square regression analysis is performed upon the formula to derive coefficients that yield the shift amounts to within the desired degree of accuracy.

6. The method of claim 1, wherein the at least one difference between the first portion's location and the second portion's location is a difference in the process direction.

7. The method of claim 1, wherein the at least one difference between the first portion's location and the second portion's location is a difference in the lateral direction.

8. The method of claim 1, wherein the first color is one of yellow, magenta, or black.

9. The method of claim 8, further comprising performing the same steps for the remaining two color separations.

10. A color-to-color calibration method for multi-color images, comprising:

determining the error between the location of a generated image and its intended location at a plurality of times;

determining an empirical formula having variable coefficients to represent the error data;

using least square regression analysis to determine the coefficients to within a desired degree of accuracy;

using the results to modify the intended location of images to be generated.

11. The method of claim 10, wherein the plurality of times are serial and separated by substantially the same time intervals.

12. The method of claim 10, wherein the generated image is substantially monochromatic.

13. The method of claim 12, wherein the steps are repeated for each color separation of an image.

* * * * *